US008708143B2

(12) United States Patent
Liu

(10) Patent No.: US 8,708,143 B2
(45) Date of Patent: Apr. 29, 2014

(54) APPARATUS FOR STORING HAND TOOLS

(71) Applicant: Yung-Yuan Liu, Taichung (TW)

(72) Inventor: Yung-Yuan Liu, Taichung (TW)

( * ) Notice: Subject to any disclaimer, the term of this patent is extended or adjusted under 35 U.S.C. 154(b) by 0 days.

(21) Appl. No.: 13/901,962

(22) Filed: May 24, 2013

(65) Prior Publication Data

US 2013/0248396 A1 Sep. 26, 2013

Related U.S. Application Data

(62) Division of application No. 13/280,584, filed on Oct. 25, 2011.

(51) Int. Cl.
*B65D 85/00* (2006.01)

(52) U.S. Cl.
USPC ..... 206/376; 206/372

(58) Field of Classification Search
USPC ..... 206/372, 379, 377, 376, 378, 775, 477; 211/70.6
See application file for complete search history.

(56) References Cited

U.S. PATENT DOCUMENTS

| | | | | | |
|---|---|---|---|---|---|
| 3,997,053 | A * | 12/1976 | Bondhus | ..... | 206/377 |
| 6,112,897 | A * | 9/2000 | Hu | ..... | 206/377 |
| 6,405,864 | B1 * | 6/2002 | Streich et al. | ..... | 206/373 |
| 6,755,302 | B1 * | 6/2004 | Streich et al. | ..... | 206/373 |
| 7,165,674 | B2 * | 1/2007 | Pangerc et al. | ..... | 206/379 |
| 7,331,456 | B2 * | 2/2008 | Pengerc et al. | ..... | 206/379 |
| 2005/0109649 | A1 * | 5/2005 | Natoli et al. | ..... | 206/372 |
| 2005/0211587 | A1 * | 9/2005 | Chen | ..... | 206/379 |
| 2005/0241974 | A1 * | 11/2005 | Chen | ..... | 206/379 |
| 2006/0278548 | A1 * | 12/2006 | Pangerc et al. | ..... | 206/379 |
| 2008/0202963 | A1 * | 8/2008 | Liao | ..... | 206/377 |

* cited by examiner

*Primary Examiner* — Steven A. Reynolds

(57) ABSTRACT

A hand tool-holding apparatus includes a frame and a storage element located in the frame. The storage element includes at least one chamber defined therein, at least one aperture in communication with the chamber, and at least one elastic tab formed in the chamber. A tool can be inserted in the chamber via the aperture and kept there by the elastic tab.

7 Claims, 12 Drawing Sheets

APPARATUS FOR STORING HAND TOOLS

CROSS-REFERENCE

The present application is a divisional application of U.S. patent application Ser. No. 13/280,584, with the filing date of Oct. 25, 2011 filed by the applicant thereof.

BACKGROUND OF INVENTION

1. Field of Invention

The present invention relates to hand tools and, more particularly, to an apparatus for storing hand tools.

2. Related Prior Art

There are hand tools for various purposes such as screwdrivers and wrenches. Even for a same function, there are hand tools of various sizes. Therefore, a mechanic cannot help but own many hand tools. The mechanic needs something to store the hand tools.

As disclosed in Taiwanese Patent M267041, a conventional toolbox includes two elements pivotally connected to each other so that they can be opened and closed. Each of the elements includes a plurality of cavities defined in a side thereof directed to the other element. Each of the cavities is used to contain a hand tool such as an Allen key. In the vicinity of each of the cavities, there is formed a pair of restraining tabs for keeping the related hand tool in the cavity. The restraining tabs are inevitably worn away by the hand tools because of repeated insertion into and removing from the related cavities. Very soon after use, the restraining tabs fail to effectively restrain the hand tools in the cavities.

The present invention is therefore intended to obviate or at least alleviate the problems encountered in prior art.

SUMMARY OF INVENTION

It is the primary objective of the present invention to provide an effective and reliable apparatus for storing hand tools.

To achieve the foregoing objective, the apparatus includes a frame and a storage element located in the frame. The storage element includes at least one chamber defined therein, at least one aperture in communication with the chamber, and at least one elastic tab formed in the chamber. A tool can be inserted in the chamber via the aperture and kept there by the elastic tab.

In another aspect, the hand tool-holding apparatus includes two frames and two storage units. The first frame includes upper and lower lugs formed thereon. The lower lug includes a cutout defined therein. The second frame includes an upper axle extending upward from an upper portion thereof and a lower axle extending downward from a lower portion thereof. The upper axle is inserted in the upper lug before the lower axle is swung in the lower lug via the cutout. The first storage element is located in the first frame. The second storage element is located in the second frame. Each of the first and second storage elements includes at least one chamber defined therein, at least one aperture in communication with the chamber, and at least one elastic tab formed in the chamber. A tool can be inserted in the chamber via the aperture and kept there by the elastic tab.

Other objectives, advantages and features of the present invention will be apparent from the following description referring to the attached drawings.

BRIEF DESCRIPTION OF DRAWINGS

The present invention will be described via detailed illustration of two embodiments referring to the drawings wherein.

DETAILED DESCRIPTION OF EMBODIMENTS

Referring to FIGS. 1 through 8, there is shown an apparatus for storing hand tools according to a first embodiment of the present invention. The hand tool-storing apparatus includes two frames 10 and 20 and two storage elements 30 and 40.

Figure 4:
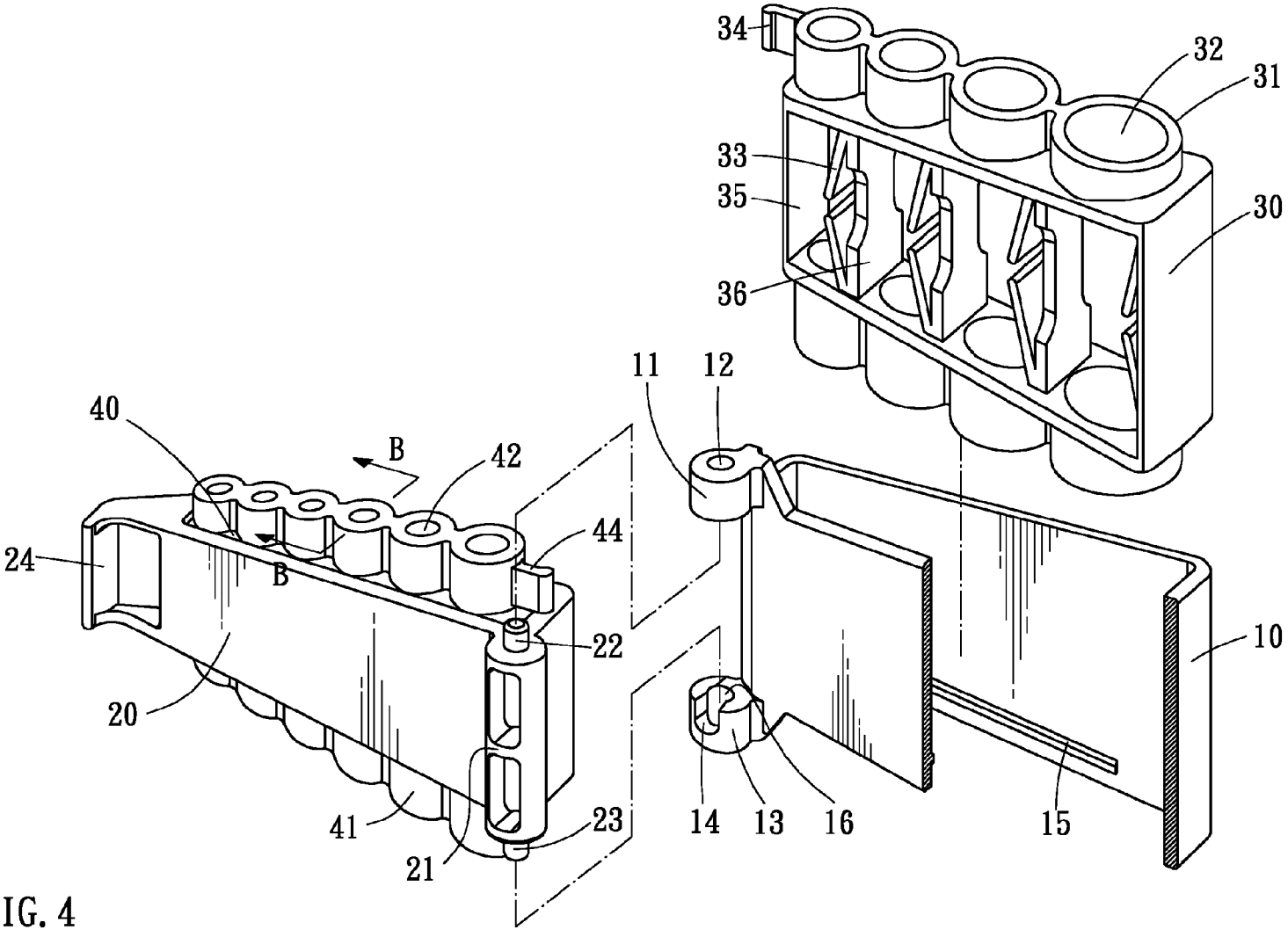
FIG. 4 is an exploded view of the apparatus for storing hand tools shown in FIG. 1.

As clearly shown in FIG. 4, the first frame 10 includes two long walls and two short walls. The first frame 10 further includes two lugs 11 and 13 formed on an external side of one of the long walls in the vicinity of one of short walls. The lug 11 includes an aperture 12 defined therein. The lug 13 includes an aperture 16 defined therein and a cutout 14 defined therein. The aperture 12 is coaxial with the aperture 16. The aperture 16 is in communication with the cutout 14. The first frame 10 further includes a rib 15 formed on an internal side of each of the long walls. There is the right angle defined between a lower face of the rib 15 and the internal side of the related long wall. The upper face of the rib 15 is a slope relative to the internal side of the related long wall.

The second frame 20 includes two long walls and two short walls. The second frame 20 further includes a cylinder 21 formed on an external side of one of the long walls thereof in the vicinity of one of short walls thereof, two axles 22 and 23 each extending from a related one of two opposite ends of the cylinder 21, and a hook 24 formed thereon opposite to the cylinder 21. To reduce the weight, the cylinder 21 may include at least one cavity defined in a side. The diameter of the axle 22 is substantially identical to the diameter of the aperture 12. The diameter of the axle 23 is substantially identical to the diameter of the aperture 16 and marginally smaller than the width of the cutout 14. The axles 22 and 23 are is coaxial with each other. As clearly shown in FIG. 5, the second frame 20 further includes a rib 25 formed on an internal side of each of the long walls thereof. There is an acute angle defined between an upper face of the rib 25 and there is the right angle defined between a lower face of the rib 25 and the internal side of the related long wall.

The first storage element 30 is a hollow element that includes two walls extending from an upper plate to a lower plate. The first storage element 30 includes four upper collars 31, four lower collars 31, a hook 34 and three partitions 36. The upper collars 31 extend upward from the upper plate of the first storage element 30 while the lower collars 31 extend downward from the lower plate of the first storage element 30. Each of the upper collars 31 is coaxial with a related one of the lower collars 31. Each of the collars 31 includes an aperture 32 defined therein. The diameters of the apertures 32 may be different from one another. The three partitions 36 are formed in the interior of the first storage element 30 so that the interior of the first storage element 30 is divided into four chambers 35 by the three partitions 36. An upper elastic tab 33 and a lower elastic tab 33 are formed in the exterior of each of the chambers 35. Each of the elastic tabs 33 extends from a partition 36 or a wall of the first storage element 30 in an inclined manner. The hook 34 extends from an external side of one of the upper collars 31.

Figure 5:
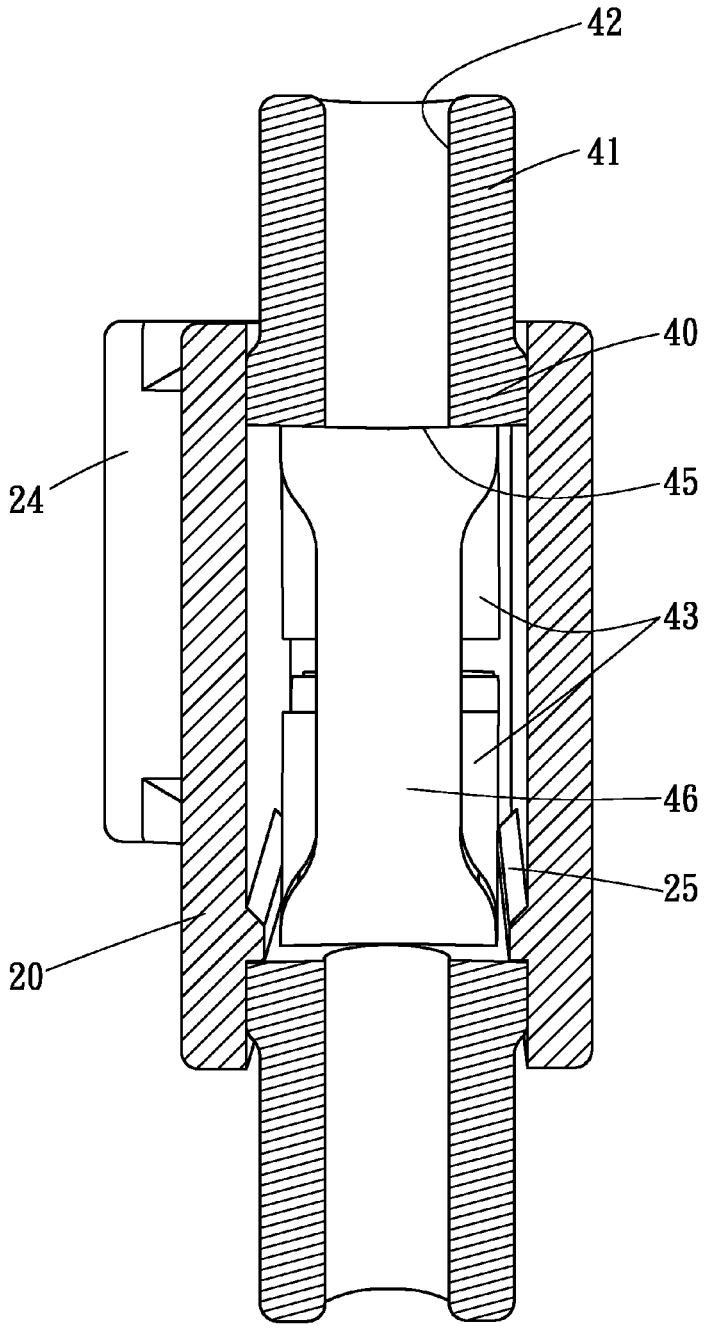
FIG. 5 is another cross-sectional view of the apparatus for storing hand tools shown in FIG. 1.
Figure 6:
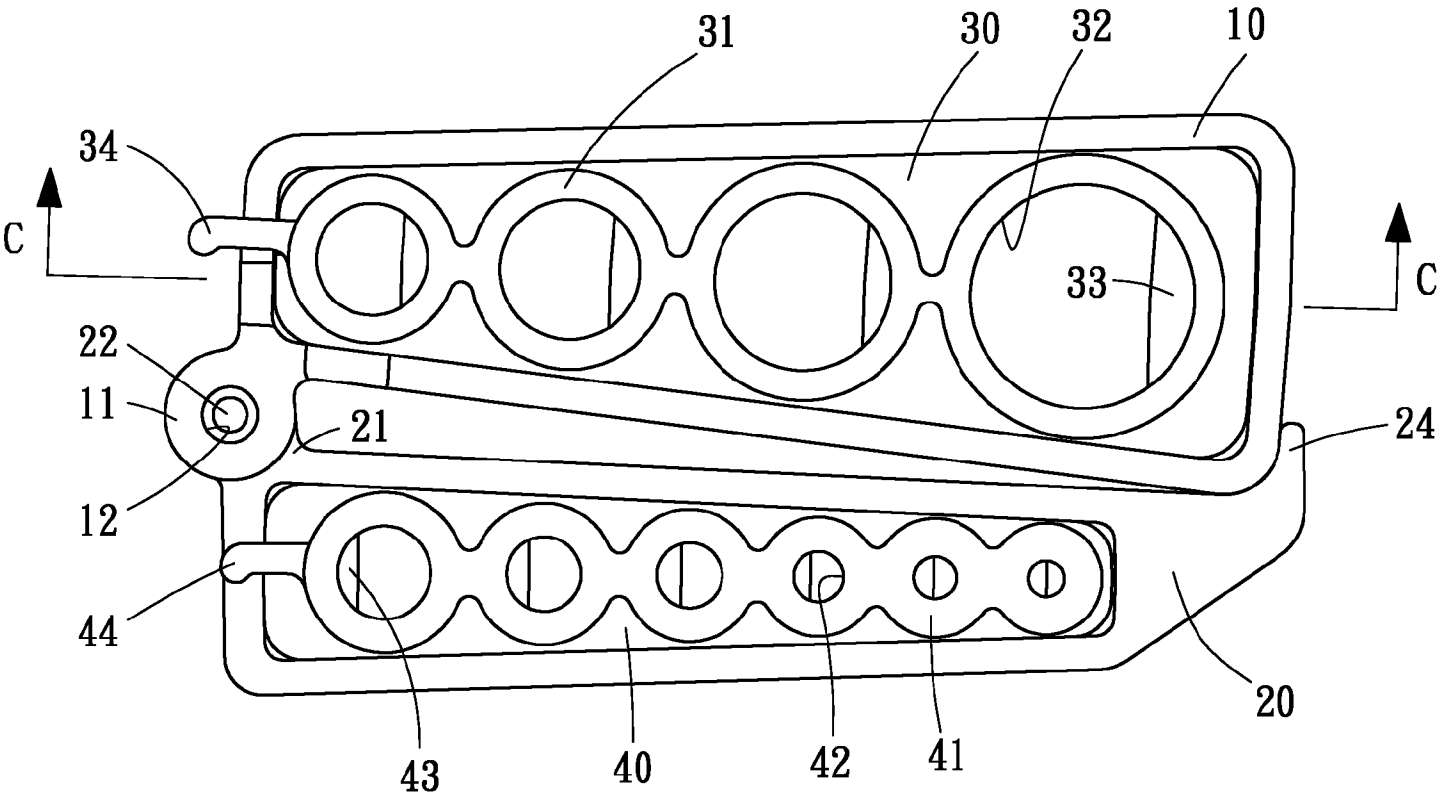
FIG. 6 is a top view of the apparatus for storing hand tools in another position than shown in FIG. 2.
Figure 7:
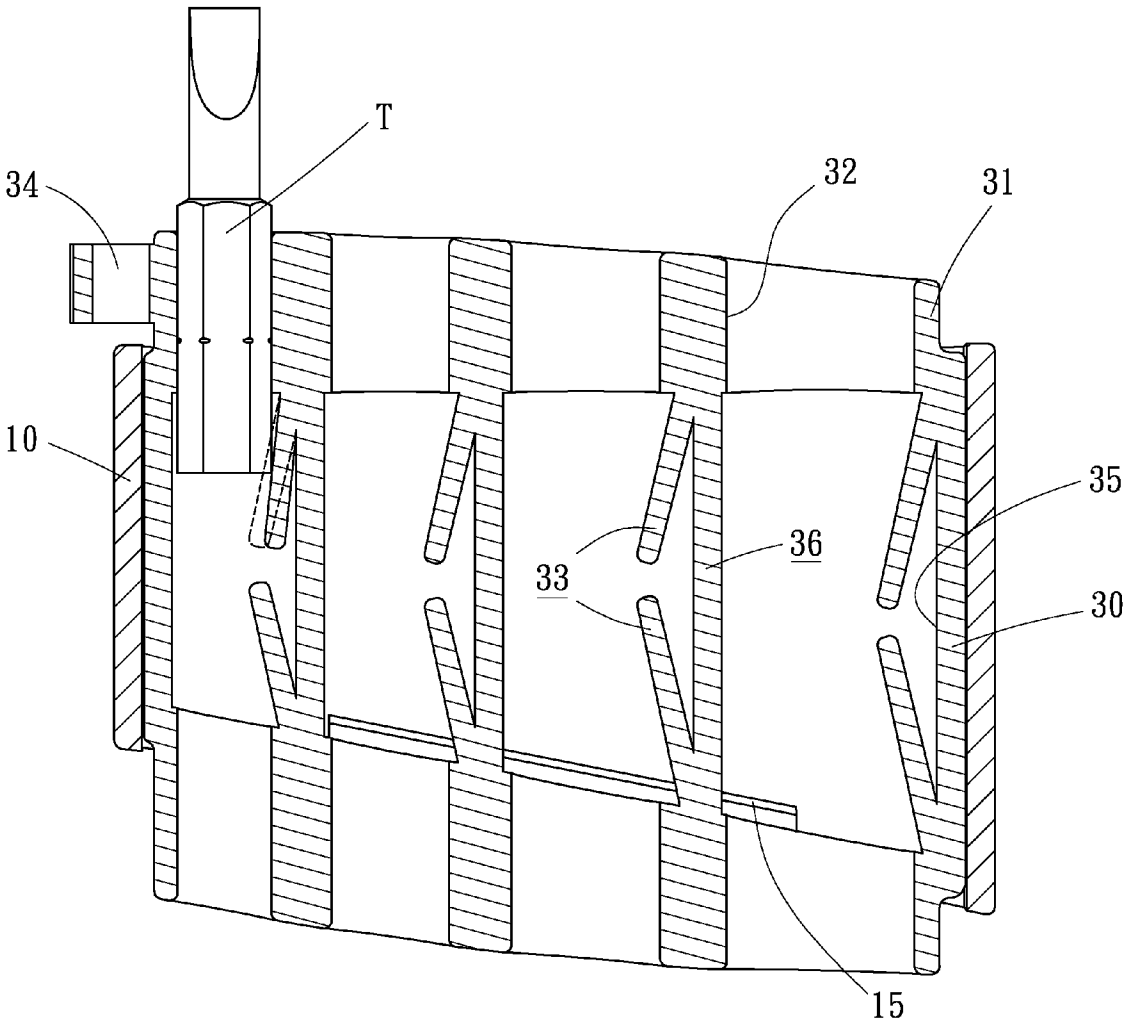
FIG. 7 is another cross-sectional view of the apparatus for storing hand tools shown in FIG. 6.

Referring to FIG. 5, the second storage element 40 is a hollow element that includes two walls extending from an upper plate to a lower plate. The second storage element 40 includes four upper collars 41, four lower collars 41, a hook 44 and three partitions 46. The upper collars 41 extend upward from the upper plate of the second storage element 40 while the lower collars 41 extend downward from the lower plate of the second storage element 40. Each of the upper collars 41 is coaxial with a related one of the lower collars 41. Each of the collars 41 includes an aperture 42 defined therein. The diameters of the apertures 42 may be different from one another. The three partitions 46 are formed in the interior of the second storage element 40 so that the interior of the second storage element 40 is divided into four chambers 45 by the three partitions 46. An upper elastic tab 43 and a lower elastic tab 43 are formed in the exterior of each of the chambers 45. Each of the elastic tabs 43 extends from a partition 46 or a wall of the second storage element 40 in an inclined manner. The hook 44 extends from an external side of one of the upper collars 41.

In assembly, the first storage element 30 is inserted into the first frame 10 as the lower plate of the first storage element 30 is moved past the upper faces of the ribs 15. Then, the lower plate of the first storage element 30 is abutted against the lower faces of the ribs 15. On the other hand, the hook 34 is abutted against an upper portion of the first frame 10. Thus, the first storage element 30 is kept in the first frame 10.

The second storage element 40 is inserted into the second frame 20 as the lower plate of the second storage element 40 is moved past the upper faces of the ribs 25. Then, the lower plate of the second storage element 40 is abutted against the lower faces of the ribs 25 as clearly shown in FIG. 5. On the other hand, the hook 44 is abutted against an upper portion of the second frame 20. Thus, the second storage element 40 is kept in the second frame 20.

Figure 3:
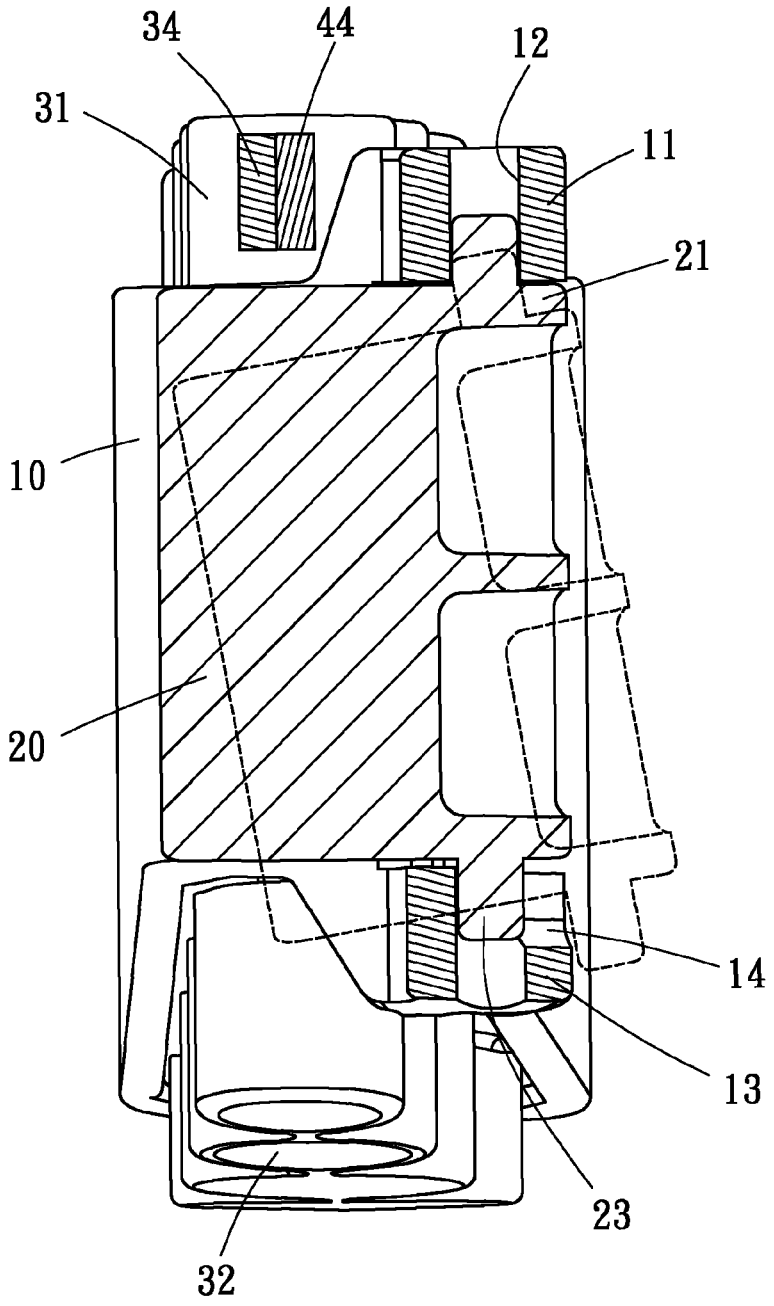
FIG. 3 is a cross-sectional view of the apparatus for storing hand tools shown in FIG. 2.

Referring to FIG. 3, the axle 22 is inserted in the aperture 12. The axle 23 is swung into the aperture 16 through the cutout 14. Finally, the axle 23 is axially inserted into the aperture 14. Thus, the second frame 20 is pivotally connected to the first frame 10.

Figure 1:
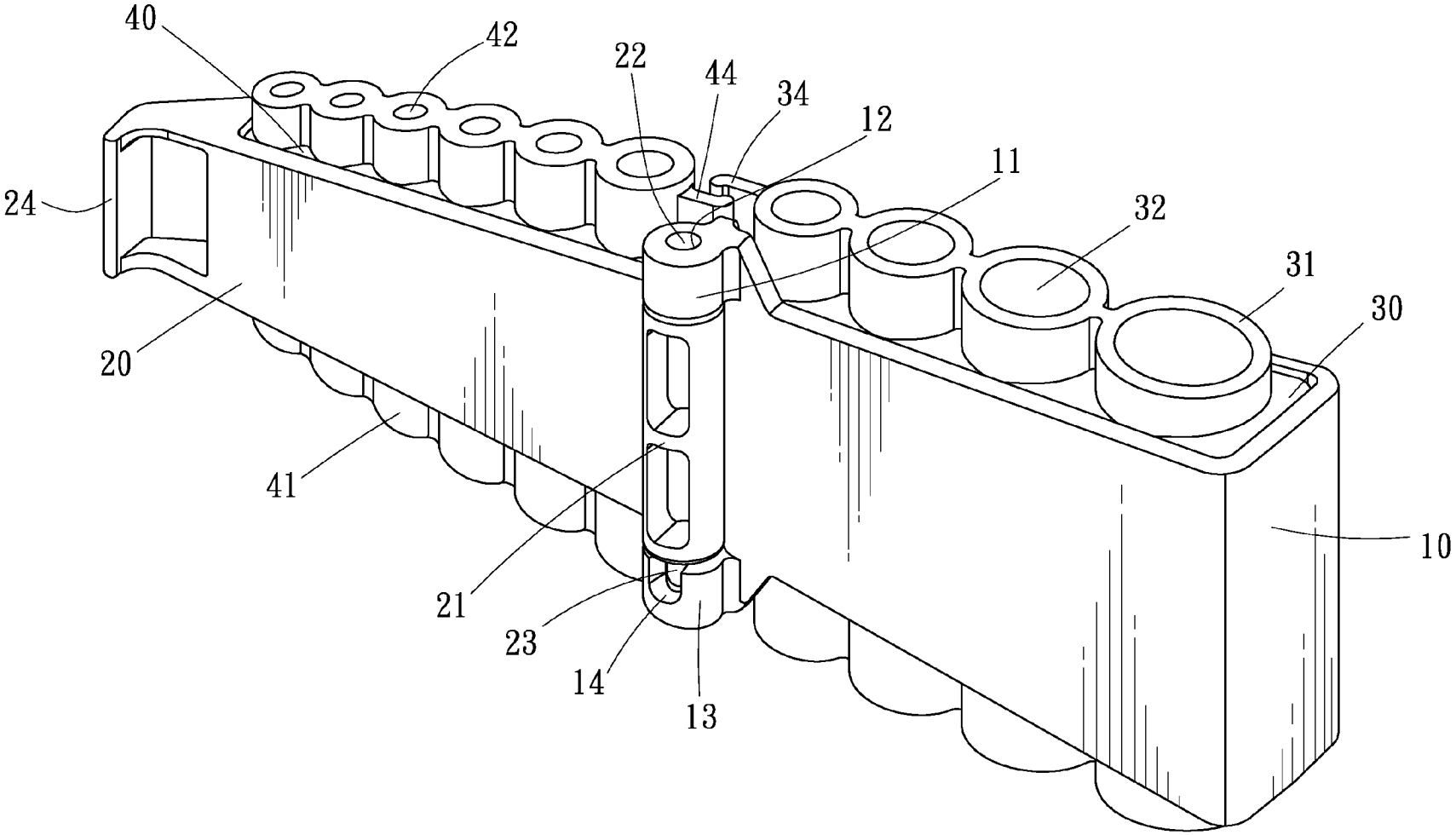
FIG. 1 is a perspective view of an apparatus for storing hand tools according to the first embodiment of the present invention.
Figure 2:
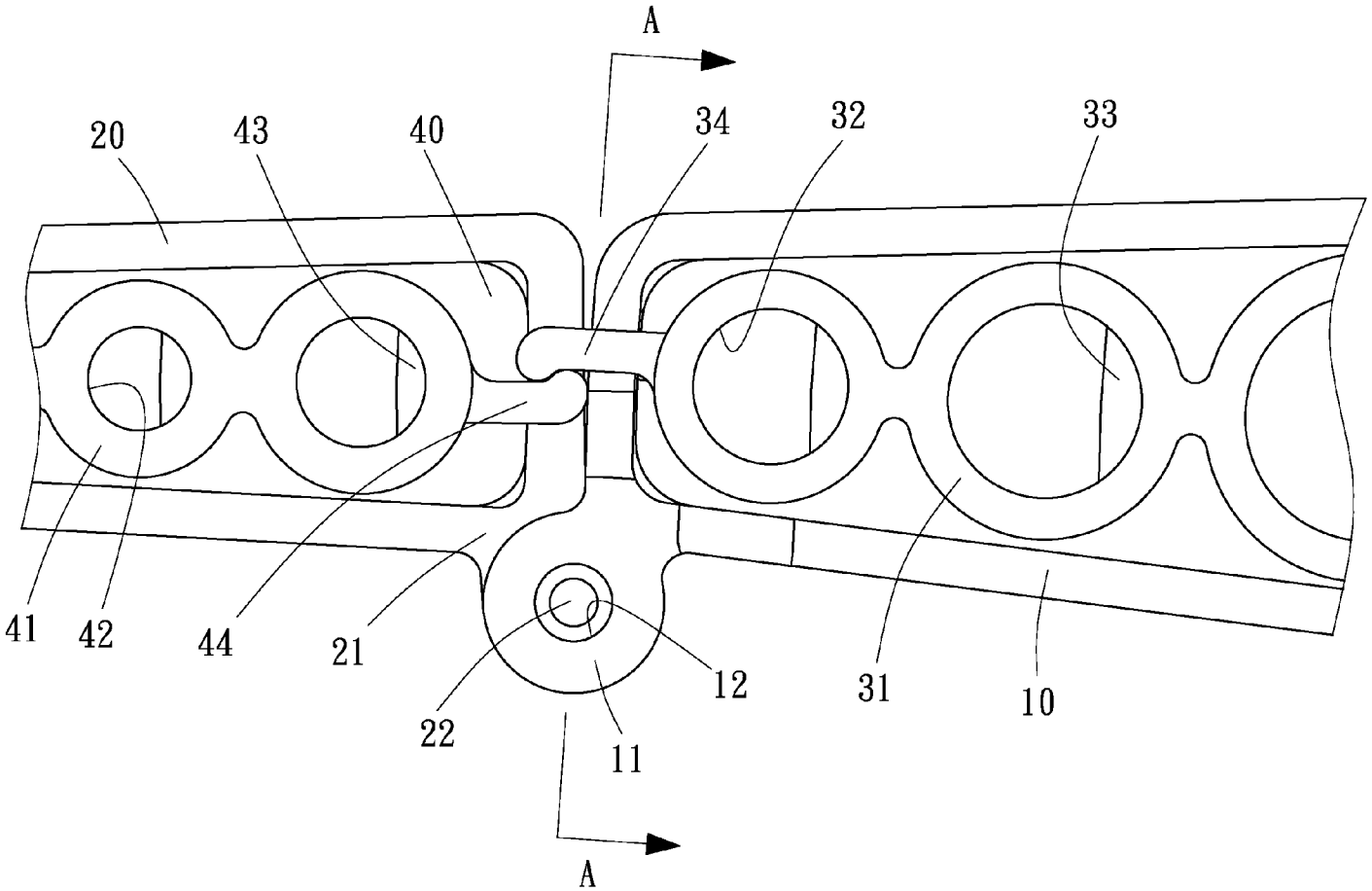
FIG. 2 is an enlarged, partial, top view of the apparatus for storing hand tools shown in FIG. 1.
Figure 8:
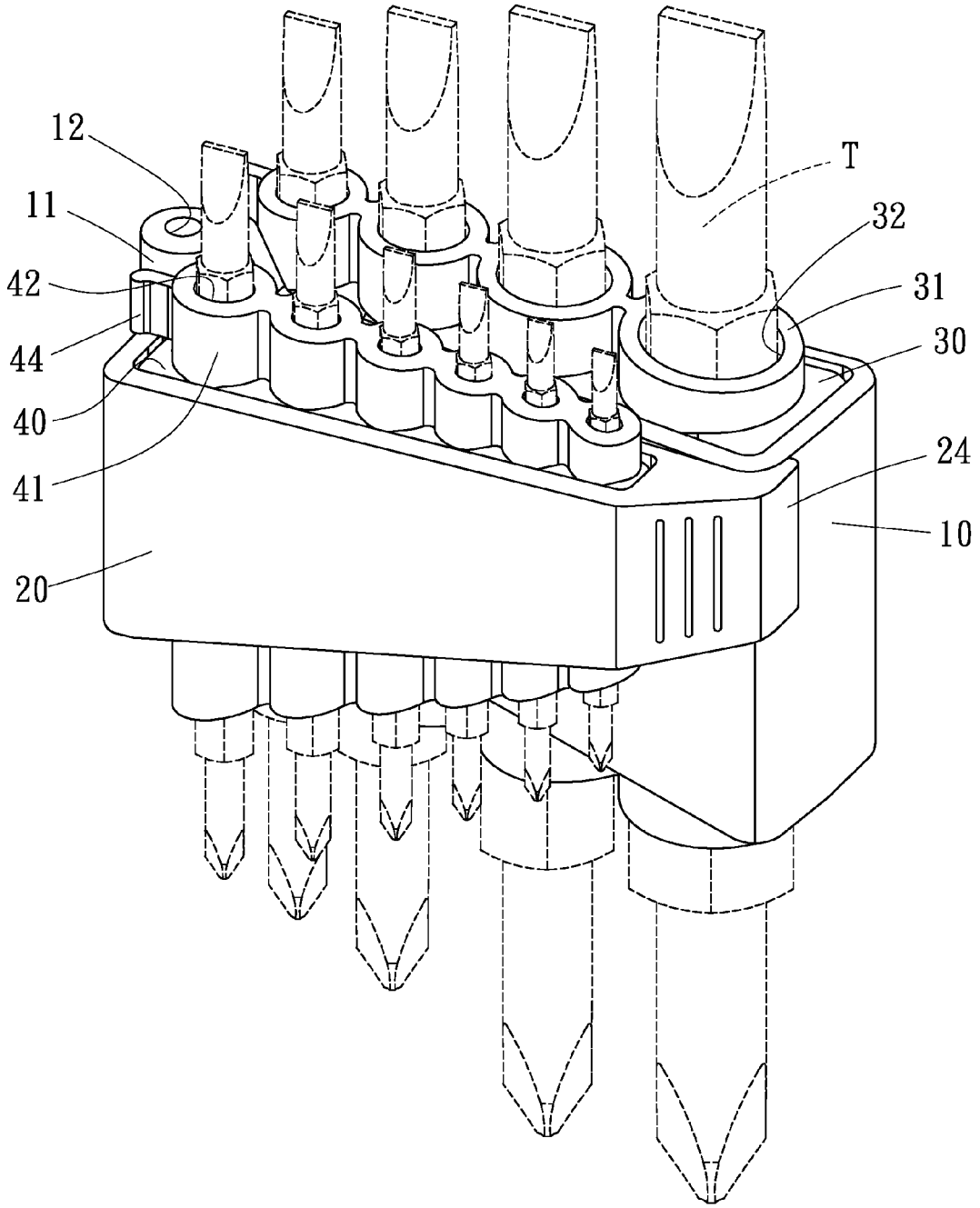
FIG. 8 is a perspective view of the apparatus for storing hand tools in another position than shown in FIG. 6.

In use, the frames 10 and 20 can be opened as shown in FIG. 1 and closed as shown in FIG. 8. As clearly shown in FIG. 2, the hooks 34 and 44 are engaged with each other so that the frames 10 and 20 are retained in the opened position. As clearly shown in FIG. 6, the hook 24 is engaged with one of the short walls of the first frame 10 so that the frames 10 and 20 are retained in the closed position.

Referring to FIG. 8, tools T are inserted in the chambers 35 and 45 via the upper and lower collars 31 and 41. The insertion and retaining of one of the tools T in the related chamber 35 are described referring to FIG. 7. The tool T is inserted in the related chamber 35 via the related upper collar 31 and kept there by the related upper elastic tab 33. It should be noted that a tool T can be inserted in the related chamber 35 via the related lower collar 31 or 41 and kept there by the related lower elastic tab 33 or 43.

Figure 9:
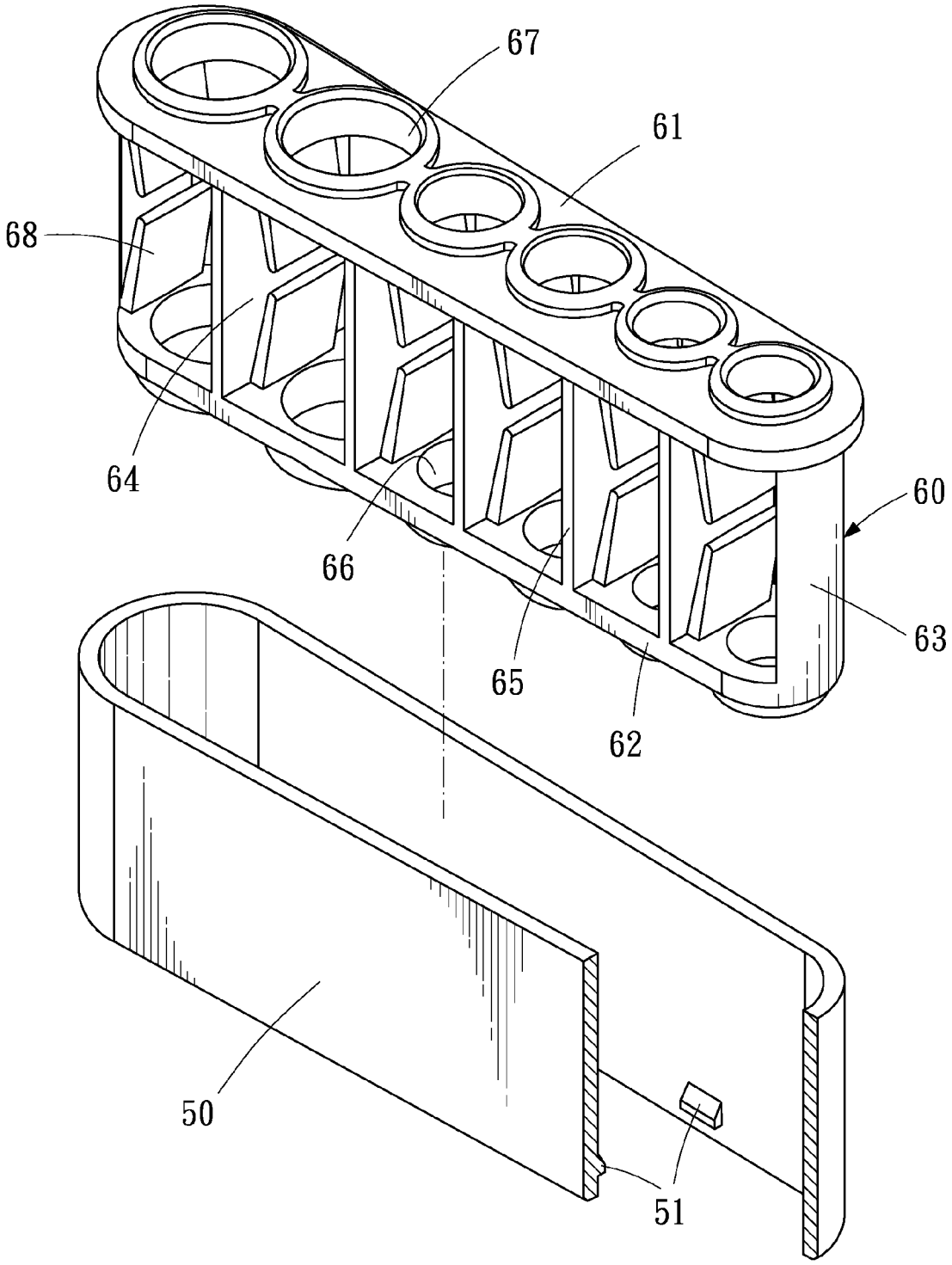
FIG. 9 is an exploded view of an apparatus for storing hand tools according to the second embodiment of the present invention.
Figure 10:
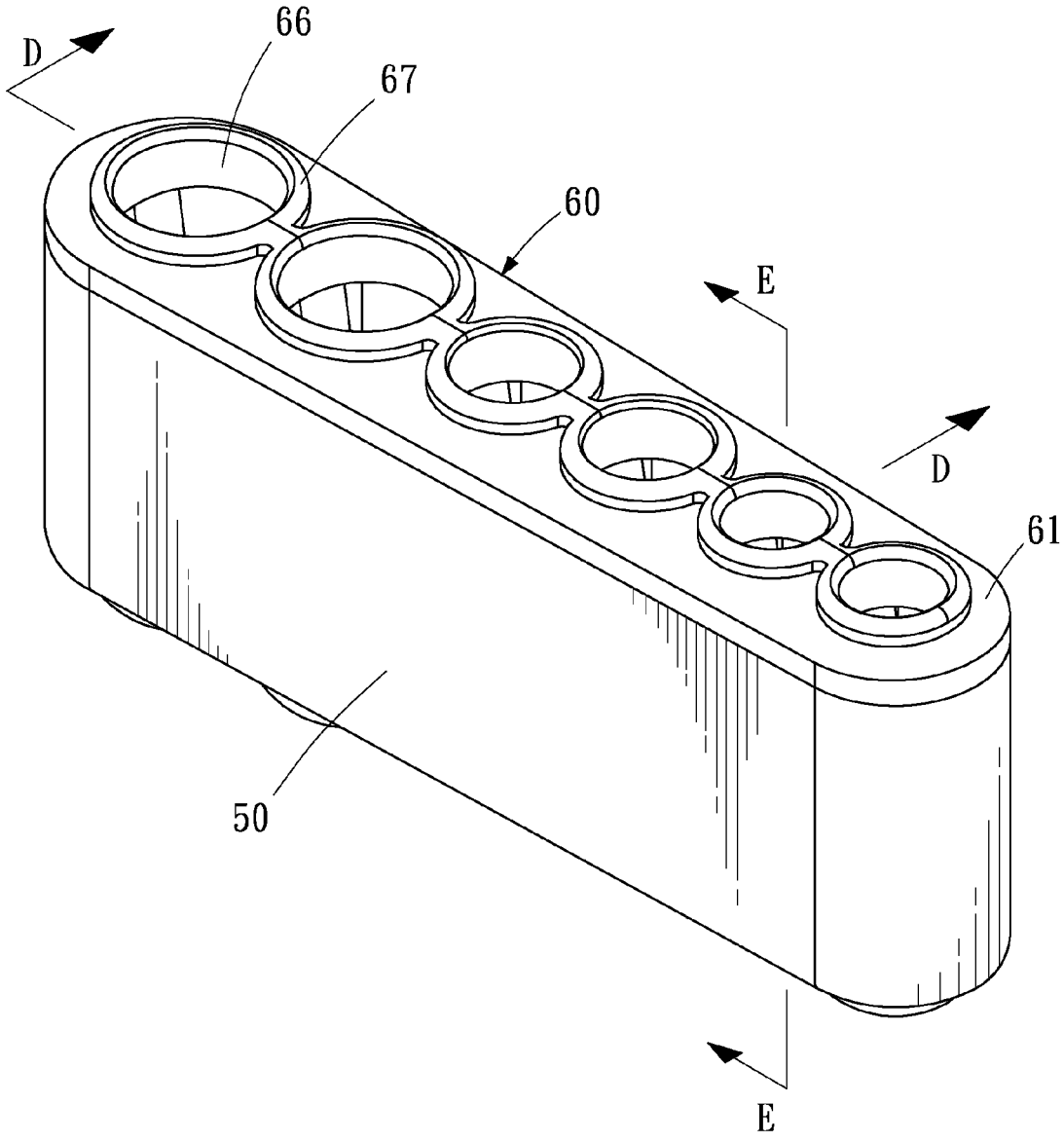
FIG. 10 is a perspective view of the apparatus for storing hand tools shown in FIG. 9.
Figure 11:
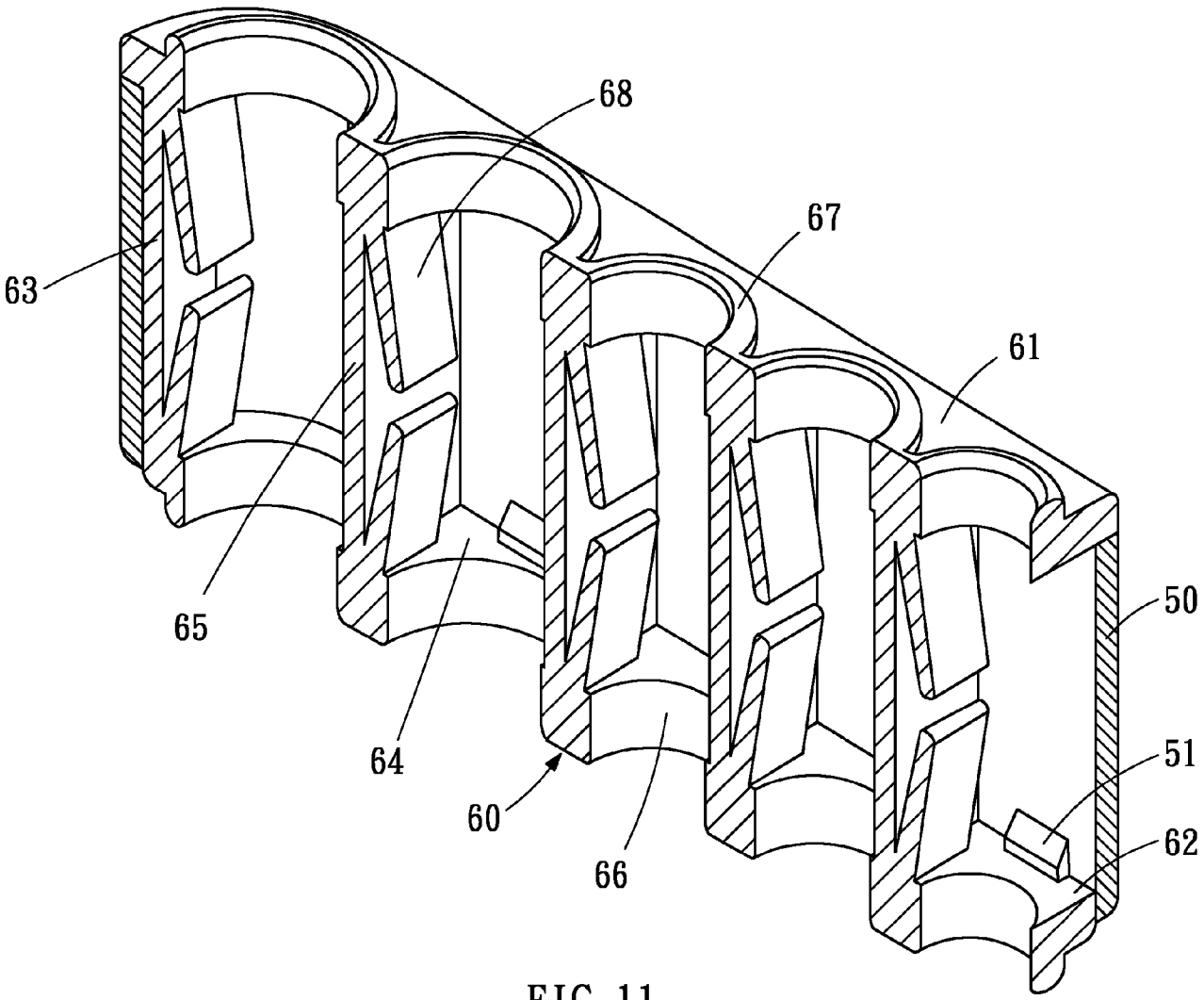
FIG. 11 is a cut-away view of the apparatus for storing hand tools shown in FIG. 10.
Figure 12:
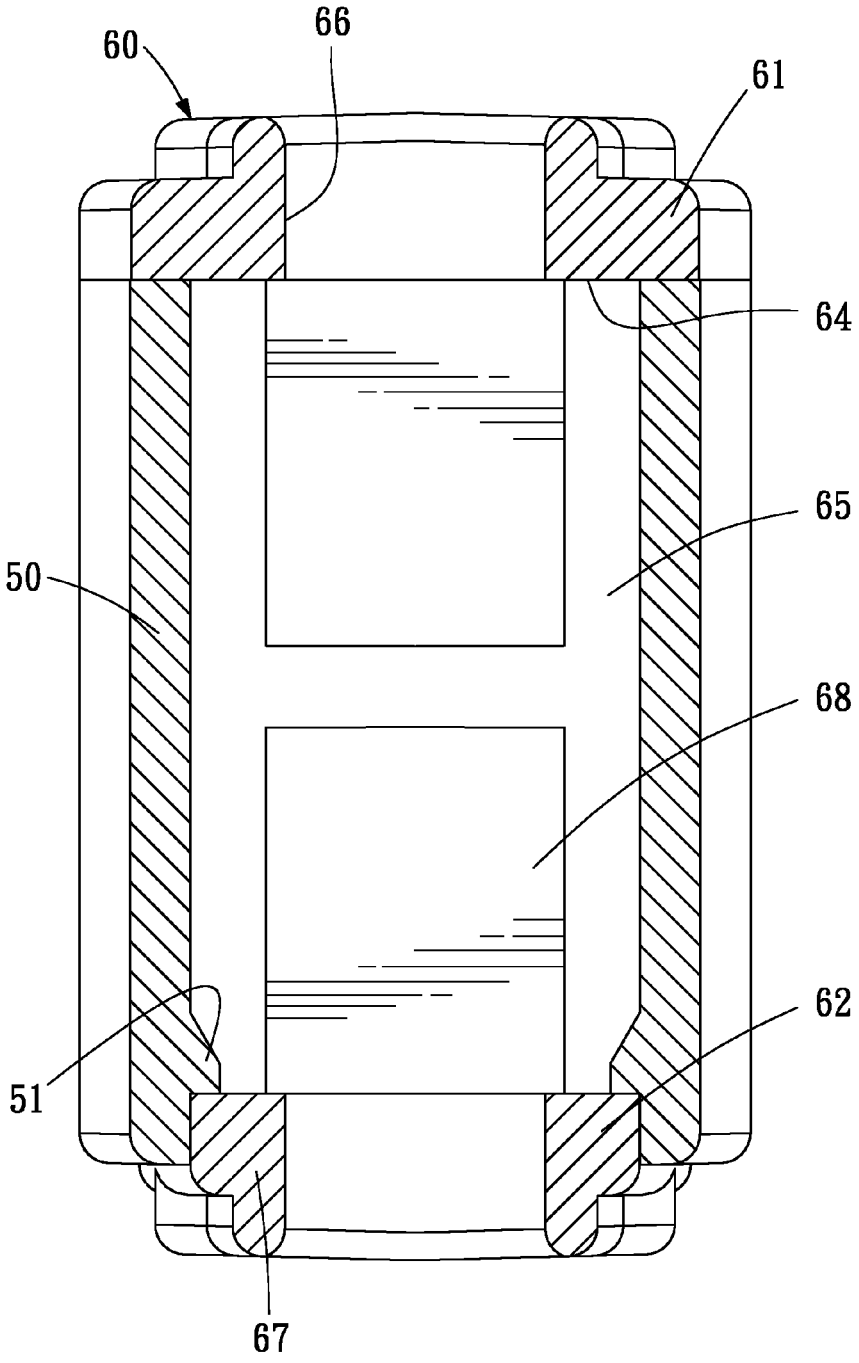
FIG. 12 is an enlarged, cross-sectional view of the apparatus for storing hand tools shown in FIG. 10.

Referring to FIGS. 9 through 11, there is shown an apparatus for storing hand tools according to a second embodiment of the present invention. The hand tool-storing apparatus includes a frame 50 and a storage element 60.

The frame 50 includes two long walls, two short walls and ribs 51 formed on an internal side of each of the long walls. There is an acute angle defined between an upper face of each of the ribs 51 and there is the right angle defined between a lower face of each of the ribs 51 and the internal side of the related long wall.

The storage element 60 is a hollow element that includes two walls 63 extending from an upper plate 61 to a lower plate 62. The area of the upper plate 61 is larger than the area of the lower plate 62. The storage element 60 includes six upper collars 67, six lower collars 67 and five partitions 65. The upper collars 67 extend upward from the upper plate 61 while the lower collars 67 extend downward from the lower plate 62. Each of the upper collars 67 is coaxial with a related one of the lower collars 67. Each of the collars 67 includes an aperture 66 defined therein. The diameters of the apertures 66 may be different from one another. The five partitions 65 are formed in the interior of the storage element 60 so that the interior of the storage element 60 is divided into six chambers 64 by the five partitions 65. An upper elastic tab 68 and a lower elastic tab 68 are formed in the exterior of each of the chambers 64. Each of the elastic tabs 68 extends from a partition 65 or a wall 63 in an inclined manner.

In assembly, the storage element 60 is inserted into the frame 50 as a portion of the storage element 60 is moved past the upper faces of the ribs 51. Then, the portion of the storage element 60 is abutted against the lower faces of the ribs 51. Each of the ribs 51 is located in a related one of the chambers 64. On the other hand, the upper plate 61 is abutted against an upper portion of the frame 50. Thus, the storage element 60 is kept in the frame 50.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A hand tool-holding apparatus including:

a frame including a rib formed on an internal side thereof, wherein the rib is formed with an upper face and a lower face; and a storage element located in the frame, wherein the storage element includes:

a lower plate including an upper face and a lower face movable on the upper face of the rib to bring the upper face of the lower plate into abutment against the lower face of the rib;

an upper plate supported on the frame as the upper face of the lower plate is placed against the lower face of the rib to retain the storage element in the frame;

at least one chamber defined therein;

at least one aperture in communication with the chamber; and at least one elastic tab formed in the chamber, wherein a tool can be inserted in the chamber via the aperture and kept there by the elastic tab.

2. The hand tool-holding apparatus according to claim 1, wherein the storage element includes two walls extending from the upper plate to the lower plate.

3. The hand tool-holding apparatus according to claim 2, wherein the aperture is defined in one of the upper and lower plates.

4. The hand tool-holding apparatus according to claim 3, wherein the storage element includes at least one collar extending from one of the upper and lower plates around the aperture.

5. The hand tool-holding apparatus according to claim 2, wherein the elastic tab extends from one of the walls in an inclined manner.

6. The hand tool-holding apparatus according to claim 2, wherein the storage element includes at least one partition extending from the upper plate to the lower plate between the walls, thus defining at least two chambers, wherein the storage element includes at least two apertures each in communication with a related one of the chambers and at least two elastic tabs each formed in a related one of the chambers.

7. The hand tool-holding apparatus according to claim 1, wherein the upper face of the rib is a slope to allow smooth movement of the lower face of the lower plate on and then past the upper face of the rib.

* * * * *